United States Patent [19]

Montreuil et al.

[11] Patent Number: 4,570,304

[45] Date of Patent: Feb. 18, 1986

[54] FASTENER FOR DISPOSABLE WASTE CONTAINER LINERS

[76] Inventors: Albert H. Montreuil; Beverly A. Montreuil, both of 4365 A-2 Springcreek Dr., Dayton, Ohio 45405

[21] Appl. No.: 483,694

[22] Filed: Jun. 7, 1983

[51] Int. Cl.[4] ..... B65D 77/10

[52] U.S. Cl. ..... 24/30.5 S; 24/563

[58] Field of Search ..... 24/30.5 R, 30.5 P, 30.5 S, 24/DIG. 28, 545, 546, 563, 570; D8/394; D9/434, 443

[56] References Cited

U.S. PATENT DOCUMENTS

| | | | |
|---|---|---|---|
| 1,700,977 | 2/1929 | Butler | 24/DIG. 28 |
| 1,878,861 | 9/1932 | Krasnow | 24/DIG. 28 |
| 3,820,200 | 6/1974 | Myers | 24/30.5 S |
| 3,962,757 | 6/1976 | Gedney | 24/30.5 S X |
| 4,189,808 | 2/1980 | Brown | 24/30.5 R |

FOREIGN PATENT DOCUMENTS

| | | | |
|---|---|---|---|
| 684419 | 4/1964 | Canada | 24/30.5 S |
| 1180784 | 6/1959 | France | 24/30.5 R |
| 172916 | 12/1921 | United Kingdom | 24/563 |

*Primary Examiner*—William E. Lyddane
*Assistant Examiner*—James R. Brittain

[57] ABSTRACT

This invention which is a product and method of securing a trash liner to a trash container consists of a thin piece of semi-flexible or rigid material into which has been cut or perforated an opening into said invention. The opening must be of sufficient size so as to allow the insertion of a section of the open end of a trash liner. All the slack material of the trash liner exposed on the outside of the trash container would be passed through the invention thereby securing the trash liner to the trash container preventing it from becoming mispositioned. The invention may also be used as a closure of the trash liner once it has been filled with waste and is ready to be removed and discarded.

1 Claim, 7 Drawing Figures

FIG. I
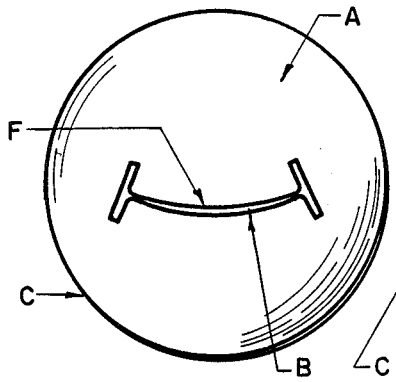
FIG. II
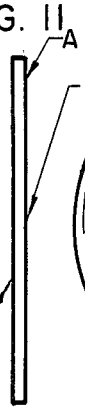
FIG. III
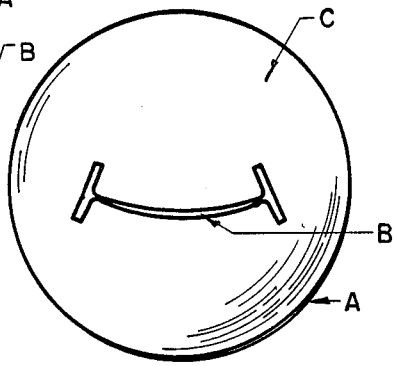
FIG. IV
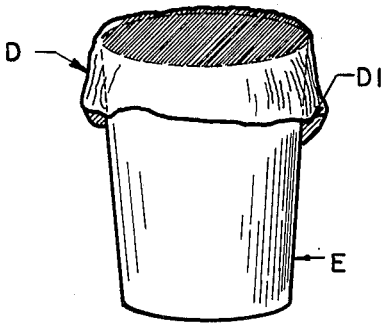
FIG. V
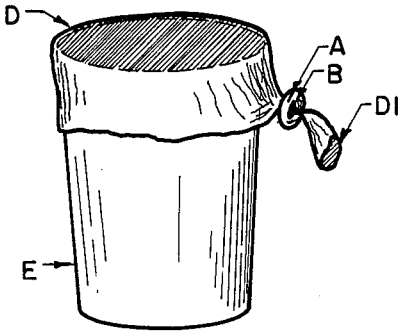
FIG. VII
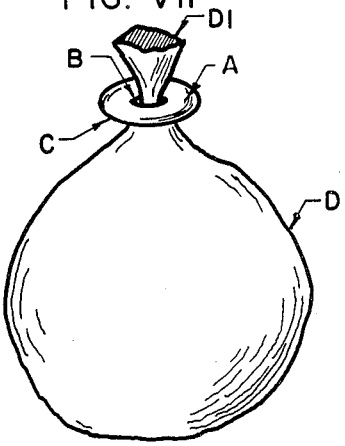
FIG. VI
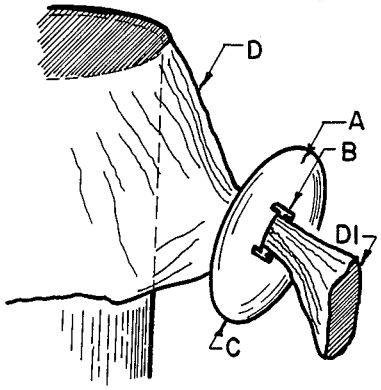

FASTENER FOR DISPOSABLE WASTE CONTAINER LINERS

FIELD OF THE INVENTION

This invention relates to disposable waste liners, specifically to a method of fastening same to the waste containers or holder (can, pail, waste basket, etc.)

DISCUSSION OF PRIOR ART

Heretofore, in the majority of applications, disposable waste liners have been loosely placed in the appropriate sized container. The excess portion of the open end of the liner is then folded loosely down around the mouth of the container. Since the liners are of an approximate size only, (1 gal., residental waste pail, waste basket sizes, etc.) they do not fit snuggly around the mouth of the container. Therefore, the liner is free to slip or be pulled down inside the container as waste is deposited there in. In outdoor applications (State parks, City streets, etc.) an additional problem is present as the liners are free to be blown out of the containers by the wind. This, of course, can happen prior to the first deposit of any refuse which if of sufficient weight serves to anchor the liner to the container. These problems are further aggravated by the slippery, light weight nature of the material used in the manufacturing of the majority of disposable waste liners.

These problems tend to defeat the original advantages of the use of a waste liner, some of which are:

a. Prevent the refuse from coming in direct contact with the container (waste food, etc.)
b. Provide a means of removing the refuse from the container without having to tip the container or empty the contents into another bag or container. When properly used the liner is simply removed, the open end fastened together thereby containing the refuse.
c. Prevent the spread of bacteria, disease, germs, etc. by allowing for the collection of contaminated material within a disposable liner such as in hospital applications (e.g. waste can liners at patients bed side, etc.)

Heretofore, disposable liners have been attached or anchored to its appropriate container by:

I. Gathering the excess liner material, which protrudes out over the mouth of the container and fashion a knot so as to reduce the size of the open end of the liner causing same to fit more snuggly to the outside surface of the container. The problems present with this method of anchoring are:
   a. Increased labor cost as the time to remove a liner (undo knot) and re-line (fashion a knot) a container is increased
   b. The disposable liner size does not always lend itself to this method of attachment. The size of the liner may not be such so as to provide sufficient excess material wherein a knot may be fashioned yet the liner opening may not be sufficiently small enough to provide a snug fit.
   c. The person placing the disposable liner in the container may not be capable of fashioning or undoing a knot in the liner. Example: children, the elderly, persons with handicaps of the fingers.

d. Due to the slippery nature of the material used in the manufacture of disposable trash liners, the knots can become unfastened.
   e. The liner usually does not fit snuggly to the outside of the container as it is not always possible to fashion a tight knot when tying sheeted slippery surfaced material.

II. The disposable liner is fastened to the container by means of a retainer ring or cover which is placed over the mouth of the container thereby anchoring the liner. The problems present with these methods are:
   a. The ring is exposed to being contaminated with the refuse being deposited into the container (food waste, bacteria ladened tissues, etc.)
   b. This method can result in the disposable liner being damaged due to the friction and pressure placed on it against the container (metal to metal).
   c. Retainer rings are not available for all shapes and sizes of waste containers.
   d. The ring or cover can interfere with the proper use of waste container.
   e. The removal of the retainer ring or cover increases the time and expense of changing liners.

OBJECTS

Accordingly several objects of my invention are to:

a. Provide an inexpensive product and method of fastening a disposable liner to a waste container so that the liner remains positioned in the container.
b. A simplified method of securing a liner to a waste container so that it may be performed by the majority of users.
c. A method of securing a disposable liner to the waste container so as not to interfere with the disposing of waste into the liner/container.
d. Anchor the disposable liner to the waste container so that in outdoor applications the liner will not be blown out of the waste can even when the liner is empty.
e. Provide a means of securing a disposable liner to a waste basket so as to enhance the appearance of both units.
f. Provide a fastener which will keep the disposable liner secured to the waste container yet be easily loosened so as to allow the removal of the filled liner from the container.
g. A simplified method of securing a disposable liner to a waste container so as not to increase significantly the amount of time required to change liners in waste containers.

The advantages of my invention over prior art are that the foregoing objects are achieved by providing a simplified product which can be used by the majority of people who are involved with the use of disposable waste can liners. Further objectives, functions, and advantages of my invention will become apparent from a consideration of the drawings and ensuing descriptions thereof.

DRAWINGS

FIG. I is a perspective FRONT view of my invention.

FIG. II is a perspective SIDE view of my invention.

FIG. III is a perspective BACK view of my invention.

FIG. IV is a perspective SIDE view of a waste container and disposable liner without the use of my invention.

FIG. V is a perspective SIDE view of a waste container and disposable liner with the use of my invention.

FIG. VI is a perspective blown up view of my invention as used in FIG. V.

FIG. VII is a perspective view of a filled trash liner with the invention fixed onto the bag as a closure.

DESCRIPTION

My invention consists of a thin piece of semi-rigid flexible material of no specific shape or dimenision REF. A, into which has been placed an opening of no specific shape or dimension REF B. The opening REF. B need only be of sufficient size so as to allow for the insertion of a section of the open end of a disposable trash liner REF. FIG. V D AND FIG. VI D. FIGS. I, II, and III of the drawings show a front, side, and rear view of the front surface A and back surface C into which has been cut or perforated an opening B. Said opening B may be of any shape or dimension so long as it provides a secure holding pressure against the inserted section of a disposable trash liner REF. FIG. V D and FIG. VI D. The type of material used is of no consequence so long as sufficient holding pressure or friction may be applied to the inserted material REF. FIG V D and FIG. VI D. My invention accomplishes this holding pressure through:

1. Expansion and then contraction of opening B when a flexible material is used and/or
2. Expansion and then contraction of opening B through movement of section F when an arcuate slotted opening is provided and/or
3. Friction pressure when opening B is cut or perforated of such a dimension so as to cause a restrictive pressure against the inserted material and/or
4. Holding pressure applied as a result of a serated opening B and/or
5. Friction holding pressure when the material used and/or the inside surface of opening B consists of a non-slippery material such as rubber The retainer and closure for a bag consists of a thin flexible disk having a continuous uninterrupted peripheral edge and a centrally located arcuate opening B extending through the disk and defined by two spaced apart complementary internal edges of the disk, each of the edges being of substantially constant curvature with one edge being convex and the other edge concave. The arcuate opening terminates at two ends within the periphery of the disk and each end comprises a slot extending substantially perpendicular to the arcuate opening, whereby the arcuate opening with the two end slots define a pair of confronting cooperating flaps in the disks for engagement with the bag.

OPERATION

The operation of this invention is quite simple as follows:

a. While grasping the invention in one hand, the user would with their other hand insert a section of a trash liner into opening "B" from side "C" or side "A" NOTE: The invention is completely reversible.
b. While holding the inserted section REF. V D1 of the trash liner REF. V D with one hand the user would then slide the invention along the trash liner toward the trash container until all the excess slack has passed through "B" and the liner now fits snuggly against the outside of the trash container.
c. When it is time to remove the trash liner "D" from the trash container "E" REF. FIG. V the user simply would grasp the invention in one hand and pull the invention off of the section of trash liner D FIG. VI. This action would provide the slack necessary for the removal of the trash liner "D" from trash container "E" FIG. IV. The invention may be reused or then used as a closure for filled trash liners as in FIG. VII. The user would, while holding the invention in one hand then insert the open end D1 of trash liner "D" into opening "B" through side "A" or "C". The unit is also reversible for this application. While holding the inserted portion D1 FIG. VII of the trash liner "D" the user would slide the inventin along the trash liner away from D1 until the invention fits snuggly against the contents of the trash liner.

While the above description contains many specifications, these should not be construed as limitations on the scope of the invention, but rather as an exemplification of one preferred embodiment thereof. Many other variations are possible, for example the invention can be any shape: round, oblong, retangular, square, etc. with the opening straight, curved, open, perforated, etc. The invention may also be used to secure, hold, or fasten other material such as rope, fabric, paper, etc. Accordingly, the scope of the invention should be determined not by the embodiment illustrated, but by a liberal interpretation of the claims attached hereto.

What is claimed:

1. A retainer and closure for a garbage can liner bag consisting of a thin flexible disk having a continuous uninterrupted peripheral edge and a centrally located arcuate opening extending through the disk, said opening defined by two spaced apart complementary internal edges of the disk, each of said internal edges of substantially constant curvature with one internal edge convex, the other internal edge concave, and the arcuate opening having two ends terminating within the periphery of said disk, each end comprising a slot defined by a continuation of said internal edges extending substantially perpendicular to the arcuate opening, thereby defining a pair of confronting cooperating flaps in the disk, whereby the disk can be utilized in a configuration in which a portion of the garbage can liner bag is drawn through the arcuate opening in the disk for restricting the bag mouth and retaining a garbage can liner around the exterior of the open top of a garbage can in which the remainder of the bag is disposed, and another configuration in which the compressed mouth of a bag is extended through the arcuate opening in the disk to close the bag.

* * * * *